US006561599B2

(12) United States Patent
Itakura

(10) Patent No.: US 6,561,599 B2
(45) Date of Patent: May 13, 2003

(54) SERVING WAGON

(75) Inventor: Ushio Itakura, Tokyo (JP)

(73) Assignee: Jamco Corporation, Tokyo (JP)

( * ) Notice: Subject to any disclaimer, the term of this patent is extended or adjusted under 35 U.S.C. 154(b) by 0 days.

(21) Appl. No.: 10/006,707

(22) Filed: Dec. 10, 2001

(65) Prior Publication Data

US 2002/0093273 A1 Jul. 18, 2002

(30) Foreign Application Priority Data

Jan. 12, 2001 (JP) ..... 2001-004347

(51) Int. Cl.[7] ..... A47B 45/00
(52) U.S. Cl. ..... 312/205
(58) Field of Search ..... 312/205, 204, 312/257.1, 236, 140.1, 140.3

(56) References Cited

U.S. PATENT DOCUMENTS 1,455,395 A * 5/1923 Exum ..... 312/236 X
1,943,282 A * 1/1934 Bellavia ..... 312/205 X
2,260,586 A 10/1941 Sheldon ..... 312/140.2
3,353,885 A * 11/1967 Hanson ..... 312/205
5,303,057 A * 4/1994 Davidow et al. ..... 312/205 X

FOREIGN PATENT DOCUMENTS

| | | | | |
|---|---|---|---|---|
| DE | 161 900 C | | 7/1905 | |
| FR | 644825 | * | 3/1964 | ..... 312/205 |
| FR | 2 155 123 A | | 5/1973 | |
| WO | WO 94/15824 | | 7/1994 | |

OTHER PUBLICATIONS

European Search Report dated Jun. 6, 2002.

* cited by examiner

*Primary Examiner*—James O. Hansen
(74) *Attorney, Agent, or Firm*—Armstrong Westerman & Hattori, LLP.

(57) ABSTRACT

A service wagon has a box-shaped body 10 having an opened upper end, and the body 10 is supported by casters. Two pullout wagon members 20 and 30 are stowed in the body 10, which are pulled out toward the side directions during use. The upper surface plates 22 and 32 of the pullout wagon members 20 and 30 serve as a cover for covering the opening of the body and as a table. Tables 60 and 70 mounted via hinges to the front and back sides of the body 10 can be expanded horizontally, and by expanding the auxiliary tables 62, 64, 72 and 74 that are folded and stowed under the tables 60 and 70, a large table surface can be obtained.

4 Claims, 6 Drawing Sheets

SERVING WAGON

FIELD OF THE INVENTION

The present invention relates to an expandable serving wagon used to serve beverages in the cabin of an aircraft and the like.

A movable wagon used for example in the passenger cabin of an aircraft comprises a box-shaped body with wheels (casters), for storing dishes and trays inside the body and mounting bottles and cartons for beverages on the top of the body when serving the passengers on board.

SUMMARY OF THE INVENTION

A wagon used specially for serving alcohol beverages and the like is proposed so as to provide better service on board an aircraft. However, such specialized wagon has a large-sized body securing a sufficiently large table surface for mounting glasses and the like, which is difficult to handle within the cabin of an aircraft having very limited space.

Therefore, the present invention provides a compact-sized wagon capable of expanding the table to provide sufficient table surface space when serving the passengers, and capable of stowing the table reducing the wagon size to approximately half the size compared to when it is expanded, thereby reducing the storage space to approximately half that of the conventional serving wagon.

The serving wagon according to the present invention comprises a box-shaped body, casters that support the body, and two pullout wagon members that are stowed to the body and capable of expanding in the side directions; wherein the body has its upper end being opened and includes two shelf boards arranged at the bottom and the center of height of the body, and the pullout wagon members each comprise an upper face plate covering the upper portion of the body when stowed and functioning also as a table, and a storage unit stowed between the two shelf boards of the body; and expandable tables mounted to the front and back sides of the body via hinges and expandable in the horizontal direction.

The expandable tables each include a main table and one or more auxiliary tables that are folded against the main table when stowed and expanded to constitute the same surface as the main table. One of the expanded tables is expanded to constitute the same surface as the table surface of the pullout wagon members, and the other expandable table is expanded at a lower position.

Moreover, the serving wagon comprises supporting members for supporting the expanded tables from below.

DETAILED DESCRIPTION OF PREFERRED EMBODIMENTS

Figure 1:
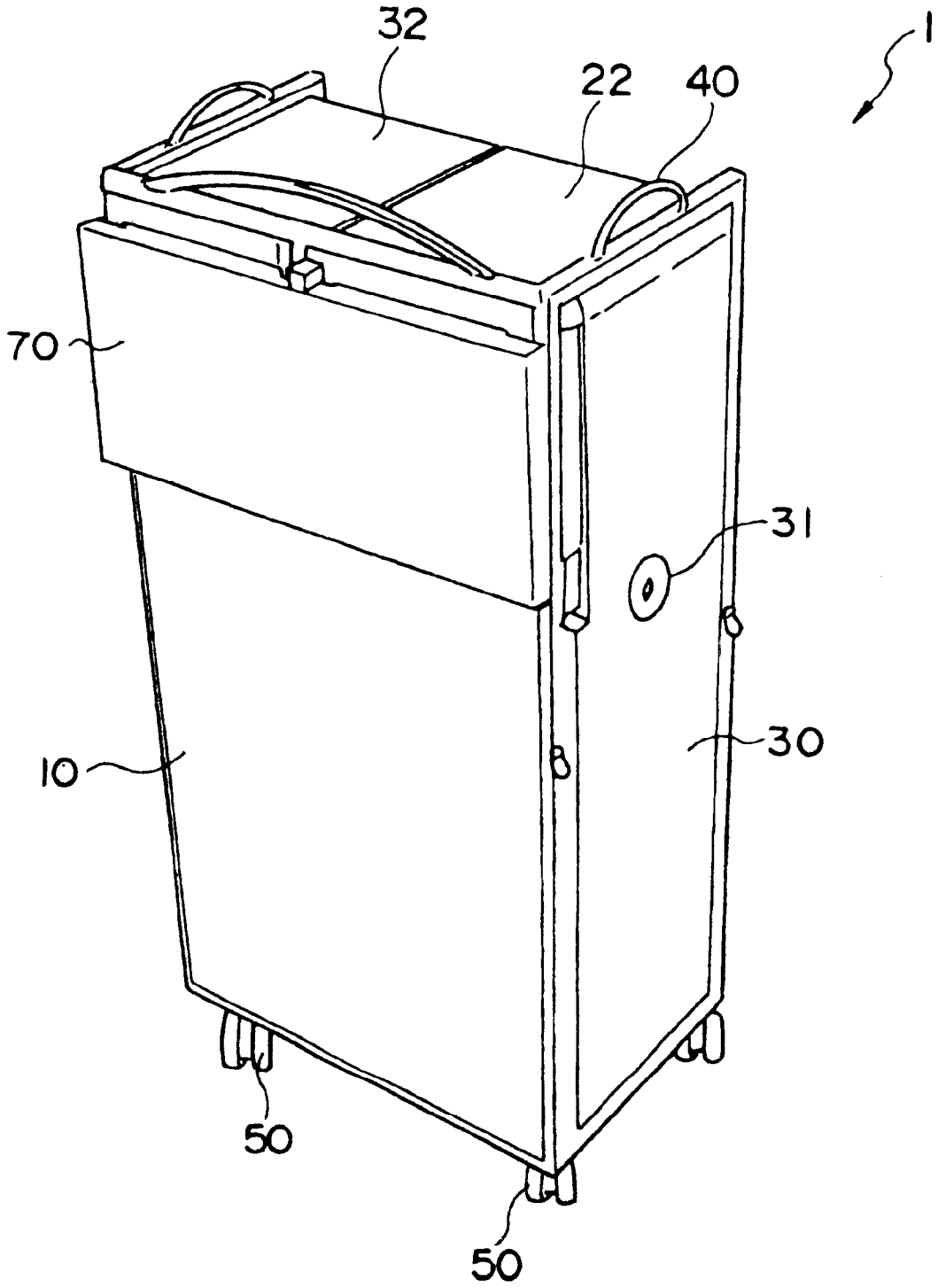
FIG. 1 is a perspective view of the serving wagon being stowed according to the present invention.
Figure 2:
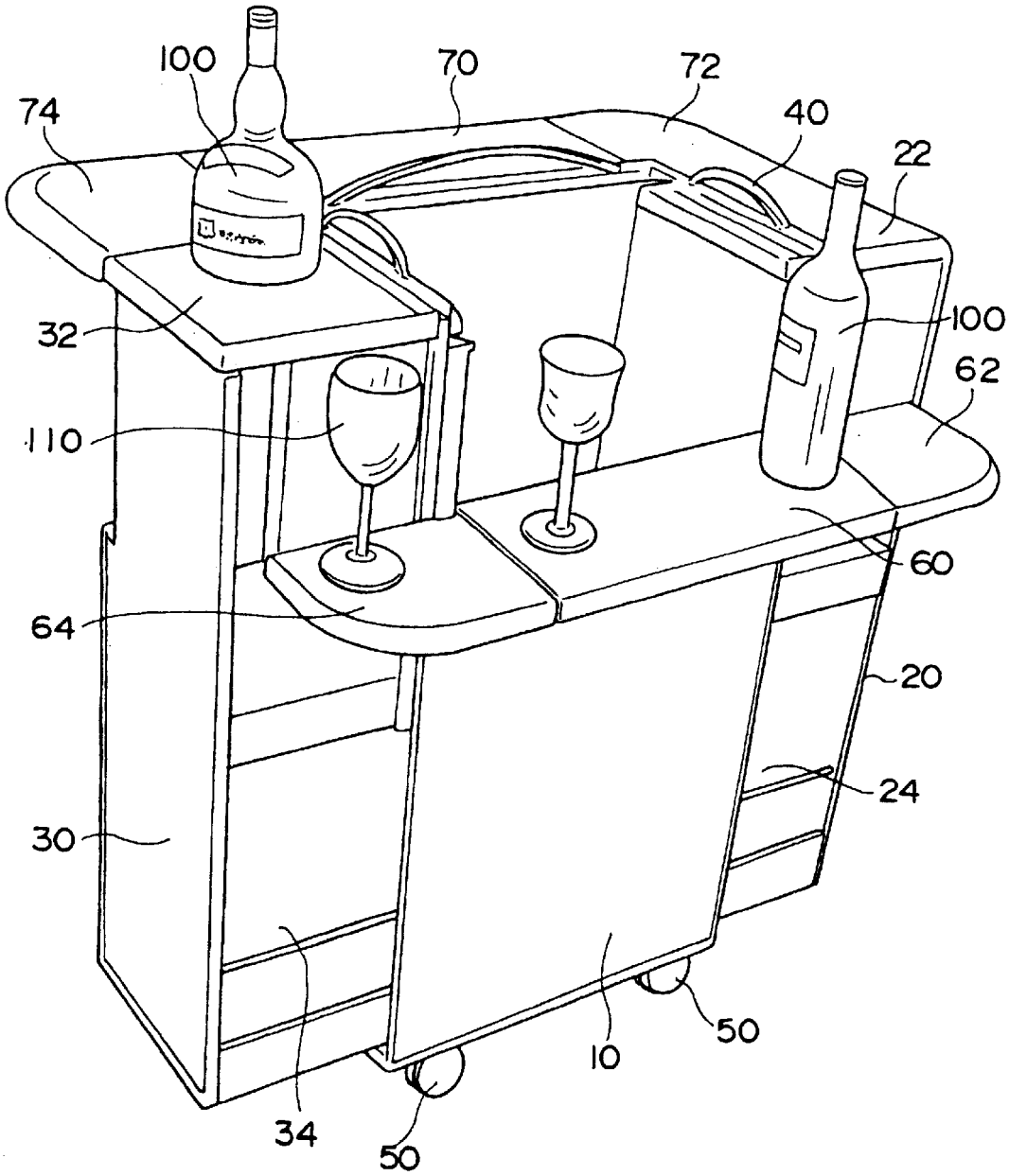
FIG. 2 is a perspective view of the serving wagon according to the present invention in which the members are expanded.

FIG. 1 is a perspective view showing the exterior of the expandable serving wagon according to the present invention in a stowed state, and FIG. 2 is a perspective view showing the exterior of the expanded wagon.

The expandable serving wagon shown as a whole by reference 1 comprises a box-shaped body 10, and an appropriate number of casters 50 are equipped to the bottom of the body 10.

The upper part of the body 10 is opened, and two shelf boards are positioned at the bottom and center of height of the body, the upper shelf storing food, beverage containers, glasses and the like to be served. The lower shelf stores the storage portions 24 and 34 of two pullout wagon members 20 and 30 that can be pulled out from the body 10 to the side directions, and the storage portions also store food, beverage containers, glasses and the like to be served.

Upper surface plates 22 and 32 of the pullout wagon members 20 and 30 serve as tables that are also used as doors that open to the storage portion on the upper shelf of the body 10.

Expandable main tables 60 and 70 are each fixed using hinges to the front wall and the back wall of the expandable serving wagon 10.

The first expandable main table 60 is fixed around the center of height of the body 10 with a hinge, the main table being supported at a right angle when expanded. Auxiliary tables 62 and 64 are mounted via hinges respectively to both ends of the first expandable main table 60, which are expanded so as to constitute the same surface as the main table 60.

The second expandable main table 70 is supported via a hinge at the upper rim of the body 10, which is supported at a right angle when expanded. Auxiliary tables 72 and 74 are mounted via hinges respectively to both ends of the second expandable main table 70, which are expanded so as to constitute the same surface as the main table 70.

As shown in FIG. 2, when expanded the upper rim of the body 10 comprises an upper table plate 22 and 32 of the pullout wagon members 20 and 30, the second expandable main table 70, and auxiliary tables 72 and 74, which constitute an upper table having a large surface area. Further, a lower table is formed around the center of height of the body 10 by the first expandable main table 60 and auxiliary tables 62 and 64.

When serving the passengers, beverage bottles 100 and glasses 110 are mounted on the tabletop and offered to passengers.

Figure 3:
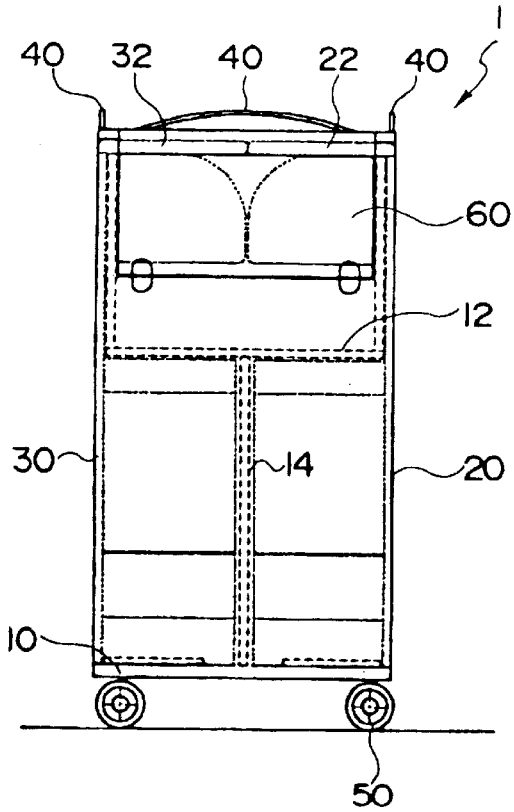
FIG. 3 is a front view of the serving wagon being stowed according to the present invention.
Figure 4:
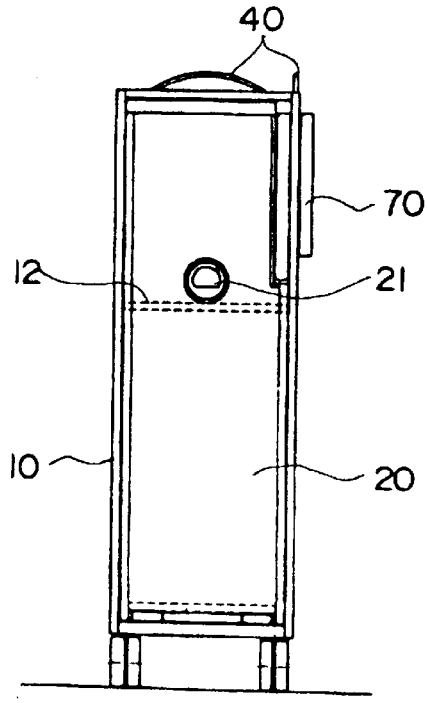
FIG. 4 is a right side view of the serving wagon being stowed according to the present invention.
Figure 5:
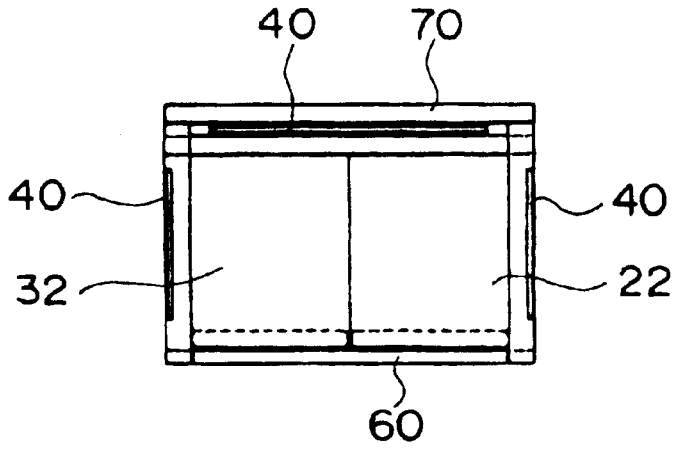
FIG. 5 is a plan view of the serving wagon being stowed according to the present invention.

FIG. 3 is a front view of the expandable serving wagon 1 at a stowed state, FIG. 4 is a right side view thereof, and FIG. 5 is an upper view thereof.

A shelf board 12 is fixed to the interior of the body 10, and a partition board 14 is formed vertically to the center of the interior of the body 10. Two pullout wagon members 20 and 30 are equipped to both sides of the partition board 14 which can be pulled out of and stowed back to the body. The pullout wagon member 20 is equipped with a handle 21 and the like, which is used when pulling the wagon member out of the body 10.

Handles 40 for moving the wagon are equipped to the upper rim portion of the body 10.

A first expandable main table 60 is mounted via hinges to the front side of the body 10, and the second expandable main table 70 is mounted via hinges to the back side thereof.

Figure 6:
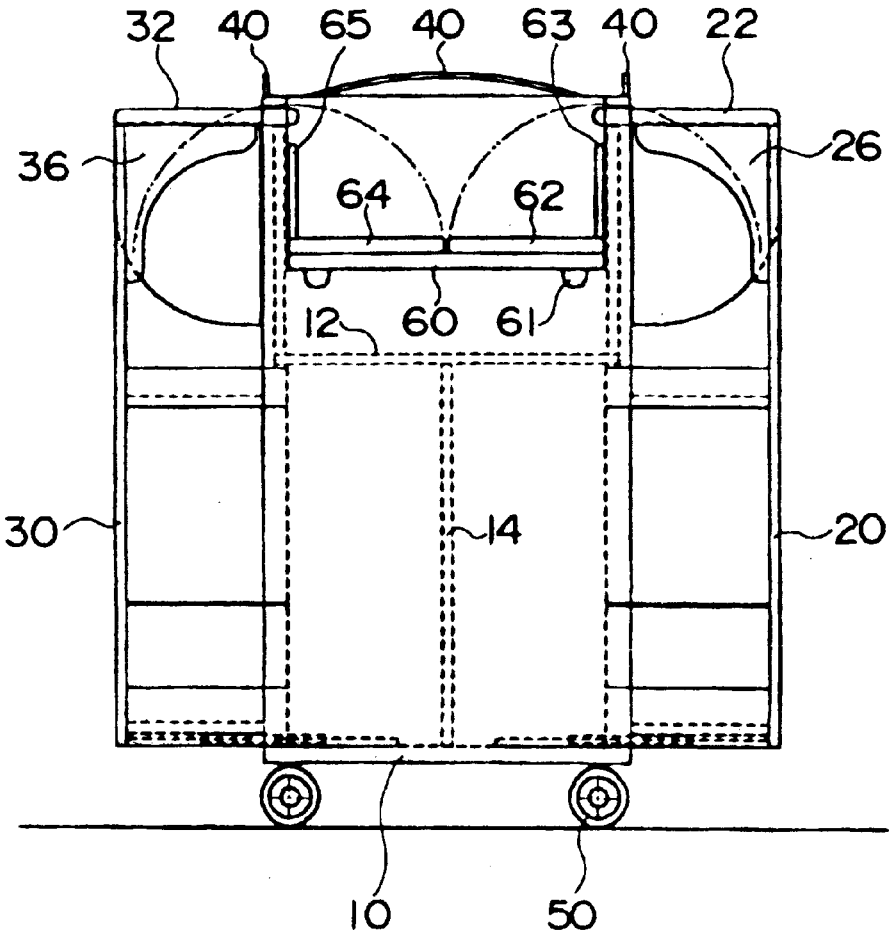
FIG. 6 is a front view of the serving wagon being expanded according to the present invention.

FIG. 6 shows the state where the two pullout wagon members 20 and 30 are pulled out of the body 10.

Figure 7:
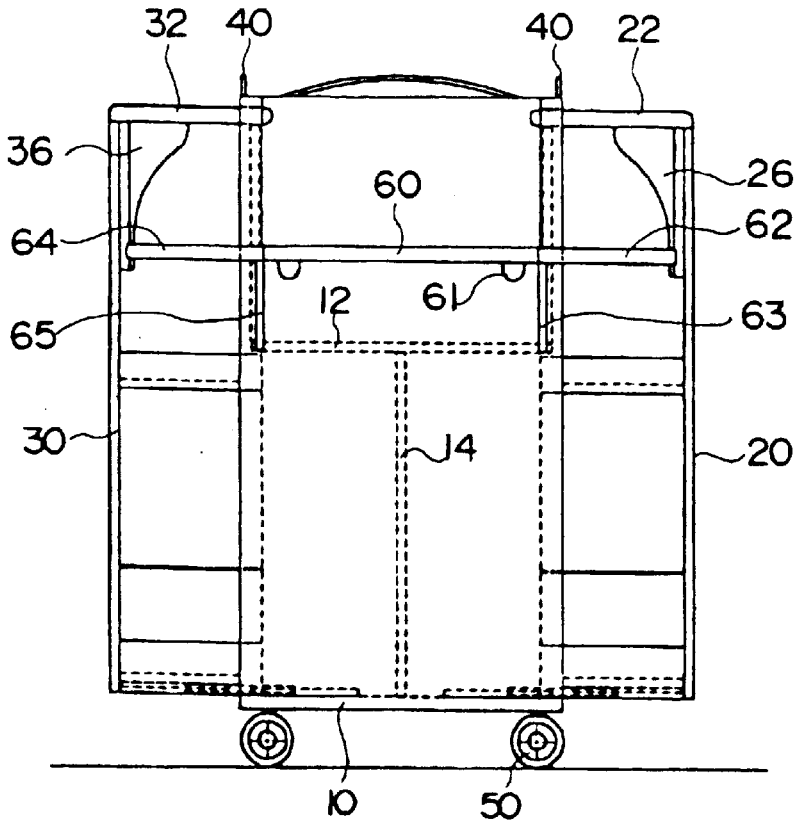
FIG. 7 is a front view of the serving wagon being expanded according to the present invention.

The first expandable main table 60 is expanded to a right angle by hinges 61. Auxiliary tables 62 and 64 are folded by hinges at both ends of the main table 60 when stowed. Support members 63 and 65 are equipped to the auxiliary tables 62 and 64, each supporting the auxiliary tables 62 and 64 at the expanded position, as shown in FIG. 7.

The side surface of each of the pullout wagon members 20 and 30 is equipped with a swivel supporting member 26 or 36, respectively, that rotate to a predetermined angle by springs and come into contact with a stopper when the members are pulled out.

Figure 8:
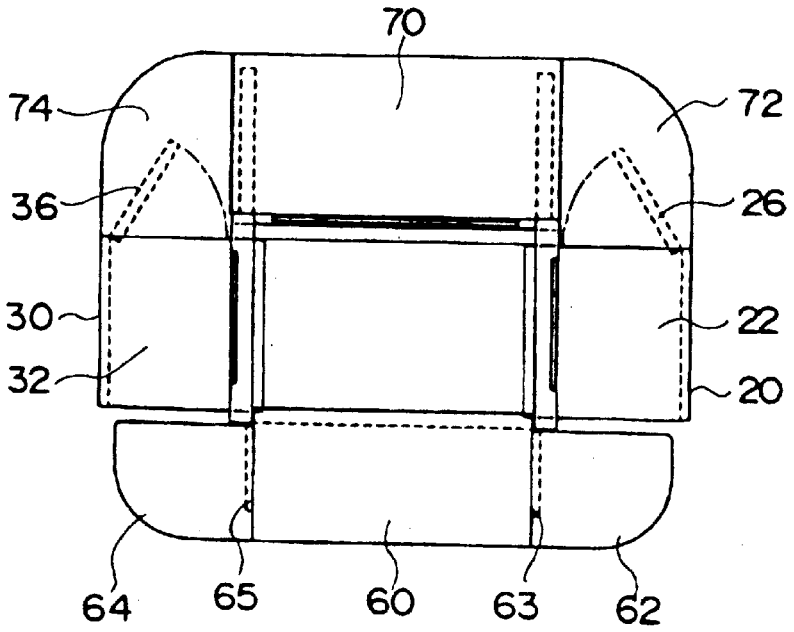
FIG. 8 is a plan view of the service wagon being expanded according to the present invention.
Figure 9:
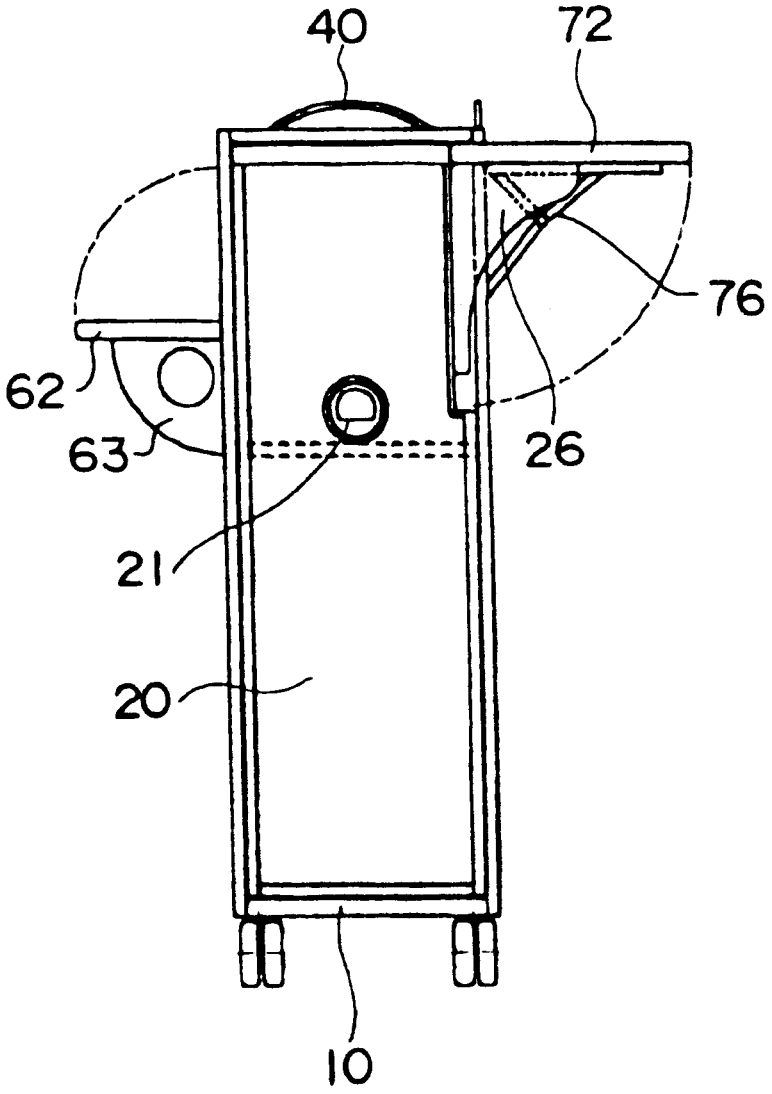
FIG. 9 is a right side view of the service wagon being expanded according to the present invention.

FIG. 8 is a plan view showing the state where the expanding tables are at their expanded state, and FIG. 9 is a right side view thereof.

The second expandable main table 70 is supported at its expanded position by a refracting-type supporting member 76.

The auxiliary tables 72 and 74 at both ends of the main table 70 are supported respectively by supporting members 26 and 36 expanding from the pullout wagon members 20 and 30.

According to the structure explained above, a table having an advantageously large space is realized.

By returning the expandable tables back to their closed positions and by stowing the pullout wagon members 20 and 30 inside the body 10, the wagon redices its size to half that of the conventional serving cart storing trays, and thus the present expandable serving wagon is advantageously easier to handle and to store on board an aircraft compared to the conventional wagon.

As explained above, the present invention provides a wagon to be used on board an aircraft, wherein the tables etc. can be expanded to secure a larger table plane when providing service to the passengers, thereby improving the quality of the service.

Further, since there are a higher table and a lower table to the wagon when the units are expanded, the serving wagon is aesthetically attractive, providing better service to the passengers.

When the tables etc. are stowed, the size of the wagon is cut down to substantially half the size of a conventional service cart, and the small-sized wagon according to the present invention is advantageous, since two wagons that are necessary to serve a general wide-body passenger aircraft having two aisles between seats can be stowed in the storage space of one conventional wagon.

I claim:

1. A serving wagon comprising a box-shaped body, casters that support said body, and two pullout wagon members that are stowed in said body and capable of expanding in the side directions of said body; wherein said body has its upper end being opened and includes two shelf boards arranged at the bottom and the center of height of said body, said pullout wagon members each comprising an upper face plate covering the upper portion of said body when stowed and functioning also as a table, and said pullout wagon members each comprising a storage portion disposed between said two shelfboards of said body when stowed; and expandable tables mounted to the front and back sides of said body via hinges and expandable in the horizontal direction.

2. A serving wagon comprising a box-shaped body, casters that support said body, and two pullout wagon members that are stowed in said body and capable of expanding in the side directions of said body; wherein said body has its upper end being opened and includes two shelf boards arranged at the bottom and the center of height of said body, said pullout wagon members each comprising an upper face plate covering the upper portion of said body when stowed and functioning also as a table, and said pullout wagon members each comprising a storage portion disposed between said two shelfboards of said body when stowed; and expandable tables mounted to the front and back sides of said body via hinges and expandable in the horizontal direction, wherein said expandable tables each include a main table and one or more auxiliary tables that are folded against said main table when stowed and expanded to constitute the same surface as said main table.

3. A serving wagon comprising a box-shaped body, casters that support said body, and two pullout wagon members that are stowed in said body and capable of expanding in the side directions of said body; wherein said body has its upper end being opened and includes two shelf boards arranged at the bottom and the center of height of said body, said pullout wagon members each comprising an upper face plate covering the upper portion of said body when stowed and functioning also as a table, and said pullout wagon members each comprising a storage portion disposed between said two shelfboards of said body when stowed; and expandable tables mounted to the front and back sides of said body via hinges and expandable in the horizontal direction, wherein one of said expandable tables is expanded to constitute the same surface as the table surface of said pullout wagon members, and the other expandable table is expanded at a lower position.

4. A serving wagon according to claim 1, further comprising supporting members that support the expanded tables from below.

* * * * *